US010918962B2

(12) United States Patent
Ryaa

(10) Patent No.: US 10,918,962 B2
(45) Date of Patent: Feb. 16, 2021

(54) TOY VEHICLE ADAPTED FOR RUNNING ON RAILS AND A TOY CONSTRUCTION SYSTEM

(71) Applicant: LEGO A/S, Billund (DK)

(72) Inventor: Jan Ryaa, Billund (DK)

(73) Assignee: LEGO A/S

( * ) Notice: Subject to any disclaimer, the term of this patent is extended or adjusted under 35 U.S.C. 154(b) by 0 days.

(21) Appl. No.: 16/470,031

(22) PCT Filed: Dec. 21, 2017

(86) PCT No.: PCT/EP2017/084055
§ 371 (c)(1),
(2) Date: Jun. 14, 2019

(87) PCT Pub. No.: WO2018/115261
PCT Pub. Date: Jun. 28, 2018

(65) Prior Publication Data

US 2019/0358554 A1 Nov. 28, 2019

(30) Foreign Application Priority Data

Dec. 22, 2016 (DK) ..... PA201671030

(51) Int. Cl.
*A63H 18/08* (2006.01)
*A63H 18/02* (2006.01)

(52) U.S. Cl.
CPC ..... *A63H 18/08* (2013.01); *A63H 18/02* (2013.01)

(58) Field of Classification Search
CPC .. A63H 17/262; A63H 17/002; A63H 33/086; A63H 17/26; A63H 19/22;
(Continued)

(56) References Cited

U.S. PATENT DOCUMENTS 806,872 A 12/1905 Clark
3,604,148 A 9/1971 Neuhierl
(Continued)

FOREIGN PATENT DOCUMENTS

CN 1439558 A 9/2003
CN 2805865 Y 8/2006
(Continued)

OTHER PUBLICATIONS

International Search Report and the Written Opinion of the International Search Authority, issued in corresponding international application No. PCT/EP2017/084055, dated Mar. 27, 2018.
(Continued)

*Primary Examiner* — Nini F Legesse
(74) *Attorney, Agent, or Firm* — Valeriya Svystun; Day Pitney LLP

(57) ABSTRACT

A toy vehicle configured for running on rails, the toy vehicle comprises a chassis comprising a first end and a second end, two side faces extending in the longitudinal direction of the toy vehicle, a top portion, at least two axels each comprising two wheels, wherein the chassis comprises at least two flexible flanges being positioned opposite each other on both sides of the chassis on each side faces. Each flexible flange comprising a snap protrusion at the extremity of the flanges, such that the snap protrusions are adapted to slide past an outer surface of a set of rails.

12 Claims, 2 Drawing Sheets

(58) Field of Classification Search
CPC .... A63H 17/264; A63H 33/042; A63H 18/08; A63H 18/02; A63H 2200/00; A63H 30/04; A63H 33/08; A63H 18/028; A63H 18/04; A63H 21/04; A63H 29/04
USPC ..... 446/93–96, 427, 444–447
See application file for complete search history.

(56) References Cited

U.S. PATENT DOCUMENTS

| | | | | | |
|---|---|---|---|---|---|
| 4,375,139 | A * | 3/1983 | Chatani | A63H 17/26 446/471 |
| D295,642 | S * | 5/1988 | Olsen | D21/495 |
| 5,118,320 | A | 6/1992 | Miller | |
| D351,631 | S * | 10/1994 | Thomsen | D21/485 |
| D394,469 | S | 5/1998 | Nielsen | |
| 6,616,500 | B1 * | 9/2003 | Harms | A63H 18/02 446/128 |
| 6,746,298 | B1 | 6/2004 | Doepner et al. | |
| D541,882 | S | 5/2007 | Petersen | |
| 2003/0017782 | A1 | 1/2003 | Man | |
| 2005/0215172 | A1 * | 9/2005 | Chen | A63H 33/086 446/427 |
| 2016/0129358 | A1 * | 5/2016 | Eversoll | A63F 13/34 463/40 |
| 2016/0139358 | A1 | 5/2016 | Park et al. | |
| 2017/0189827 | A1 * | 7/2017 | Chin | A63H 17/262 |

FOREIGN PATENT DOCUMENTS

| | | | |
|---|---|---|---|
| CN | 101229443 | A | 7/2008 |
| CN | 201578855 | U | 9/2010 |
| CN | 201940048 | U | 8/2011 |
| CN | 102711938 | A | 10/2012 |
| CN | 103083917 | A | 5/2013 |
| CN | 203577317 | U | 5/2014 |
| DE | 972194 | C | 6/1959 |
| DE | 1703876 | A1 | 3/1972 |
| DE | 2345113 | A1 | 1/1975 |
| EP | 0269098 | A2 | 6/1988 |
| GB | 1302499 | A | 1/1973 |
| JP | S56-75999 | U | 6/1981 |

OTHER PUBLICATIONS

International Report on Patentability and the Written Opinion of the International Search Authority, issued in corresponding international application No. PCT/EP2017/084055, dated Jun. 25, 2019.
Novelty Search issued corresponding Danish priority application No. PA 2016 71030, dated Jun. 29, 2017.
International Search Report and the Written Opinion of the International Search Authority, issued in related international application No. PCT/EP2017/084058, dated Mar. 19, 2018.
Novelty Search issued in related Danish priority application No. PA 2016 71031, dated Jun. 29, 2017.
International Preliminary Report on Patentability (including correspondence and amended pages of claims attached thereto), issued in related international application No. PCT/EP2017/084058, dated Dec. 4, 2018.
Non-Final Office Action issued in related U.S. Appl. No. 16/470,536, dated May 29, 2020.
Chinese First Office Action issued in related application No. CN 201780080127.0, dated Jul. 27, 2020. (6 pages).
English translation of Chinese First Office Action issued in related application No. CN 201780080127.0, dated Jul. 27, 2020 (9 pages).
Chinese Office Action issued in related Chinese application No. 201780085997.7, dated Oct. 10, 2020. (Original) (8 pages).
Chinese Office Action issued in related Chinese application No. 201780085997.7, dated Oct. 10, 2020. (English language translation) (9 pages).

* cited by examiner

TOY VEHICLE ADAPTED FOR RUNNING ON RAILS AND A TOY CONSTRUCTION SYSTEM

CROSS-REFERENCE TO RELATED APPLICATIONS

This application is a U.S. National Stage of International Application No. PCT/EP2017/084055, filed on 21 Dec. 2017 and published on 28 Jun. 2018, as WO 2018/115261 A1, which claims the benefit of priority to Danish Patent Application No. DK PA201671030, filed on 22 Dec. 2016. The content of each of the above referenced patent applications is incorporated herein by reference in its entirety for any purpose whatsoever.

The present invention relates to a toy vehicle configured for running on rails, the toy vehicle comprises a chassis comprising a first end and a second end, two side faces extending in the longitudinal direction of the toy vehicle and a top portion, the toy vehicle comprising at least two axels, said at least two axels each comprising two wheels.

Furthermore, the present invention relates to a toy construction system.

BACKGROUND OF THE INVENTION

Various toy vehicles for running on rails are well known.

U.S. Pat. No. 5,118,320 discloses a roller coaster or gravity motive toy. The toy has a tortuous elevated track layout and toy vehicle system including adjustable support stanchions for the track attached thereto by a universal joint. The vehicle includes rollers movably supporting the vehicle on the track with pivotal roller guide and lateral securement elements to detachably couple the vehicle to the track.

In many cases, it is desirable to provide a toy vehicle having a simple construction, which is easy to mount on the rails and still runs at high speed on rails without unintended derailment.

BRIEF DESCRIPTION OF THE INVENTION

It is an object of the present invention to provide a high speed toy vehicle that avoids derailment.

This is achieved in that the chassis comprises at least two flexible flanges, the two flexible flanges are positioned opposite each other on both sides of the chassis on each side faces, each flexible flange comprising a snap protrusion at the extremity of the flanges, the snap protrusions extend towards each other in a direction parallel to the extension of said at least two axels, the at least two flexible flanges are flexible in a direction away from each other in a direction transverse the longitudinal direction of the toy vehicle, such that the snap protrusions are adapted to slide past an outer surface of a set of rails.

Hereby is achieved that the toy vehicle is snapped onto the rails by means of a snap projection that only touches the tracks when the car tends to leave the track e.g. during turns or loops.

The tendency to tilt the toy vehicle on the rails 21 is minimized, and friction between the flexible flange 17 and a rail 21 is minimized, thus higher speed is obtained.

In an embodiment, the at least two flexible flanges are positioned in the longitudinal direction centrally between the at least two axels.

In an embodiment, each of the two side faces comprise an outer planar surface extending in the longitudinal direction of the toy vehicle, said outer planar surfaces of said two side faces being parallel.

In an embodiment, the at least two flanges and the side faces of the chassis extend in a common plane.

In an embodiment, the wheels are affixed to the at least two axels, such that the at least two axels and the wheels rotate as one cohesive unit.

In an embodiment, the axels and wheels form one cohesive unit manufactured by injection molding or 3D printing.

Hereby reduced production costs are achieved.

In an embodiment, the wheels comprise a cone-shaped protrusion extending coaxially with the axles.

In an embodiment, the chassis comprises pairs of oblong recesses, the oblong recesses being positioned opposite each other on the inner surface of the side faces, the oblong recesses adapted to obtain the cone-shaped protrusion of the wheels.

Hereby, a low friction wheel bearing is obtained, and the toy vehicle runs at high speed.

In an embodiment, the first end and the second end of the chassis comprise complementary coupling organs.

In an embodiment, the first coupling organ comprising two flexible arms extending towards each other, and the second organ comprises a loop, the first coupling organ and the second coupling organ extend in a direction transversely each other, the first coupling organ being adapted for grapping the second coupling organ.

Hereby is provided a visible distinction between the front and back of a series of toy vehicles, as the first and second end of the toy vehicle differs and thereby makes assembly of several toy vehicles on the rails easier for especially younger users. Furthermore, the principle of a snap connector with a rod and an open snap ring to connecting toy vehicles allow the rod to move freely in all directions when assembled.

In an embodiment, the chassis comprises coupling members which are adapted for detachably interconnecting the toy vehicle with one or more toy construction elements comprising couplings members.

In another aspect of the invention, the toy construction system comprises rail track construction elements and toy construction elements, said rail track construction elements and toy construction elements comprising coupling members for detachably interconnecting the elements, the rail track construction elements comprises parallel extending rails, the distance between the rails being smaller than the distance between the flexible flanges in a direction transversely to the longitudinal direction of the toy vehicle, said toy vehicle being adapted for snap onto said rail track construction elements.

Hereby, increased variability of interaction between a natural three-dimensional structure and the virtual world is achieved. For example, a user may construct a large variety of spatial structures each defining a different pattern of touch points, thus allowing a user to construct a variety of spatial structures that may each be recognized by a processing device having a touch screen.

Each toy construction member comprises coupling members for detachably interconnecting the toy construction members to create spatial structures. Hence, toy construction members that have been interconnected with each other by means of the coupling members can again be disconnected from each other such that they can be interconnected again with each other or with other toy construction members, e.g. so as to form a different spatial structure.

It should be emphasized that the term "comprises/comprising/comprised" when used in this specification is taken to specify the presence of stated features, integers, steps or components but does not preclude the presence or addition of one or more other features, integers, steps, components or groups thereof. Likewise, it should be clear that the embodiments above are presented as separate embodiments, but could be combined as desired by the person skilled in the art.

BRIEF DESCRIPTION OF THE DRAWINGS

An embodiment of the invention will be described in the following with reference to the drawings wherein.

DETAILED DESCRIPTION OF THE INVENTION WITH REFERENCE TO THE FIGURES

The present invention relates to a toy vehicle configured for running on rails.

Furthermore, the present invention relates to a toy construction system.

In that context it may be convenient to define that the term "longitudinal direction" of the toy vehicle in the current specification and appended figures is meant to refer to the direction which runs along the length of the toy vehicle, from a first end to a second end, such that when the toy vehicle moves along the rails, the toy vehicle moves in the "longitudinal direction".

Figure 1:
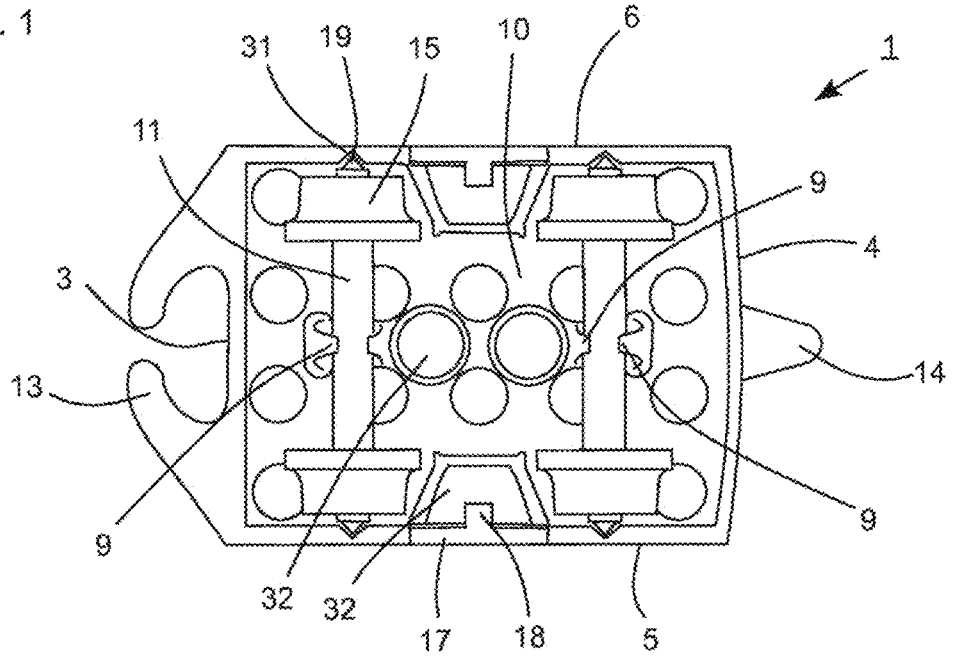
FIG. 1 is a bottom view of a toy vehicle.

FIG. 1 illustrates a bottom view of a toy vehicle 1 adapted for running on rails.

The toy vehicle 1 comprises a chassis 10 comprising a first end 3, a second end 4, and two side faces 5,6 extending in the longitudinal direction of the toy vehicle 1. The first end 3 and the second end 4 are connected by the two side faces 5,6. The chassis 10 comprises a top portion 7 comprising coupling members 30. Together the first end 3, second end 4, the side faces 5,6 and the top portion 7 define a block-shaped chassis 10.

The toy vehicle 1 comprises two axels 11. The two axels 11 each comprise two wheels 15. The chassis 10 comprises two flexible flanges 17. The two flexible flanges 17 are positioned opposite each other on both sides of the chassis 10 on each side faces 5,6.

Each flexible flange 17 comprises a protrusion 18 at the extremity of the flexible flanges 17. The protrusion 18 extends towards each other in a direction parallel to the extension of said at least two axels 11.

Each of the two side faces 5,6 comprise an outer planar surface extending in the longitudinal direction of the toy vehicle 1. The outer planar surfaces of the two side faces 5,6 extend in two planar surfaces which are parallel. The flexible flanges 17 extend in the same plane as the side faces 5,6 of the chassis 10. One flexible flange 17 and the first side face 5 are positioned in a common plane, and another flexible flange 17 and the second side face 6 lie in a common plane. The two flexible flanges 17 extend in two parallel planes.

The wheels 15 comprise a cone-shaped protrusion 19 coaxial with the axles 11. The protrusions 19 are positioned centrally on the outer portions of the wheels 15 and they protrude away from the central part of the axle 11.

The chassis 10 comprises pairs of oblong recesses 31. The oblong recesses 31 are positioned on the inner surface of the opposite positioned side faces 5,6. The oblong recess 31 is adapted to obtain the cone-shaped protrusion 19 of the wheels 15.

The wheels 15 are affixed to the two axels 11, such that the axels 11 and wheels 15 rotate as one cohesive unit within the oblong recesses 31.

Preferably, one axle and two wheels form one cohesive unit. The unit may be injection molded which reduces production costs.

The two flexible flanges 17 are positioned in the longitudinal direction centrally between the two axels 11 on each side faces 5,6.

The toy vehicle 1 comprises two axels 11 each axel comprising two wheels 15. Each wheel 15 comprises a centrally positioned cone-shaped portion 19, which is adapted for abutting an oblong recess 31 on the inner surface of the side face 5,6 of the toy vehicle.

The chassis 10 comprises axle support arms 9. The axle support arms 9 comprise a gap which allows for passage of the axle 11 through the axle support arms 9 when mounting the wheels 15 and axels 11 to the toy vehicle 1. The gap between the support axle arms 9 is smaller than the thickness of the axles 11, the axle support arms 9 being adapted to block the axles 11 for unintentional separation from the toy vehicle 1.

The axle support arms 9 encircle the two axels 11, leaving room for movement of the axels toward and away from the chassis 10, such that the cone-shaped portions 19 of the wheels are slidable within the oblong recesses 31, without unintended detachment of the axle and wheels.

The toy vehicle shown in FIG. 1 comprises coupling members 30 positioned on the top portion 7. The toy vehicle comprises complementary shaped coupling organs 13,14 positioned at the first end 3 and the second end 4, respectively, of the toy vehicle.

Figure 2:
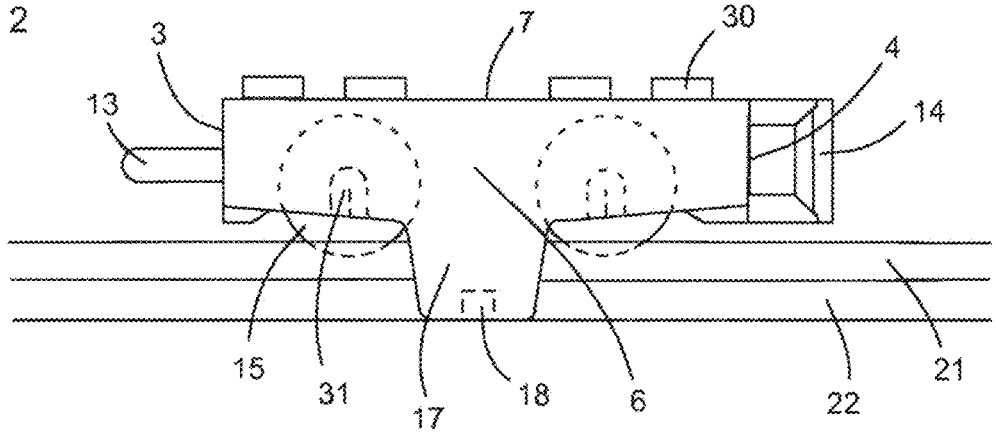
FIG. 2 is a side view of a toy vehicle and a rail track construction element.

FIG. 2 illustrates a side view of the toy vehicle having a construction similar to the toy vehicle illustrated in FIG. 1. The toy vehicle is snapped onto a rail 21 and the supportive rail web 22.

The toy vehicle 1 comprises the first coupling organ 13 at the first end 3 and the second coupling organ 14 at the second end 4. The first coupling organ 13 is adapted to be coupled to a second coupling organ 14 of another toy vehicle, to form a series of toy vehicles, like a train comprising successive wagons coupled together.

The first end 3, comprising the first coupling organ 13, and the second end 4, comprising the second coupling organ 14, may represent the front and back portion, respectively, referring to the direction in which the toy vehicle moves on the rails, thus providing a visible distinction between the front and back of a series of toy vehicles, as the first and second end of the toy vehicle differs and thereby makes assembly of several toy vehicles on the rails easier.

The toy vehicle 1 comprises a side face 5 comprising a flexible flange 17 extending downwards passing the outer surface of the rail 21. The flexible flange 17 comprises a snap protrusion 18 positioned at the extremity of the flexible flange 17 below the rail 21. The snap protrusion 18 protrudes towards the longitudinal center line of the toy vehicle towards the rail web 22.

The flexible flange 17 is positioned centrally between the two wheels 15.

In FIG. 2 the snap protrusion 18, the wheel 15 (partly) and the oblong recess 31 in the side face 6 are illustrated by dotted lines as these features are within the chassis 10.

The top portion of the toy vehicle 1 comprises coupling members 30 in the form of studs.

FIGS. 1 and 2 illustrate the first coupling organ 13 comprising two flexible arms extending towards each other, and the second organ 14 which comprises a loop. The second coupling organ 14 may be in form of a vertical hitch. The first coupling organ 13 extends horizontally and the second coupling organ 14 extends vertically. The first coupling organ 13 and the second coupling organ 14 extend in a direction transversely each other. The first coupling organ 13 is adapted for grapping the second coupling organ 14.

The principle of connecting a toy vehicle by a snap connector with a rod and an open snap ring allows the rod to move freely in all directions when assembled.

Thus, the first and second coupling organs 13,14 allow great mobility when two toy vehicle are coupled together as the two toy vehicles may move in great angles relative to each other in the longitudinal direction e.g. during turns.

Figure 3:
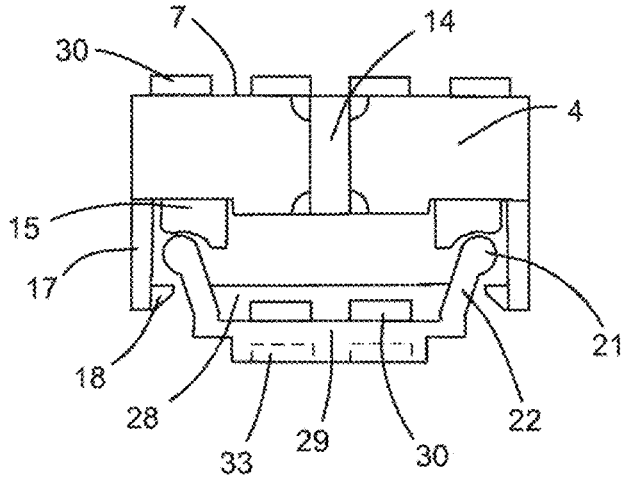
FIG. 3 is an end view of a toy vehicle.

FIG. 3 illustrates a view of the second end 4 of the toy vehicle illustrated in FIG. 2.

The chassis comprises two flexible flanges 17. The two flexible flanges 17 are positioned opposite each other on both sides of the chassis 10 on each side faces 5,6.

The flexible flanges 17 extend downwards passing the outer surface of the rail 21.

The flexible flange 17 comprises a snap protrusion 18 positioned at the extremity of the flexible flange 17. The toy vehicle 1 is snapped onto the rails 21 and the snap protrusion 18 is positioned below the rail 21.

The snap protrusion 18 protrudes towards the longitudinal center line of the toy vehicle, towards the rail web 22. The wheels 15 rest on the rails 21.

The innermost side face of the wheels 15 comprises a rim 16, such that the wheels 15 are formed like a train wheel. The wheels 15, the flexible flange 17 and the snap protrusion 18 together encircle the rails 21 to avoid unintentional derailment.

The toy vehicle 1 comprises a side face 5 comprising a flexible flange 17 extending downwards passing the outer surface of the rail 21. The flexible flange 17 comprises a snap protrusion 18 positioned at the extremity of the flexible flange 17 below the rail 21. The two snap protrusions 18 protrude in a direction towards each other, towards the rail web 22, underneath the rails 21.

Generally, the snap protrusion 18 is positioned at a distance from the wheels 15. The distance is bigger than the height of the rails 21, such that the snap protrusion 18 is adapted to touch the rails 21 when the wheels are lifted off from the rails. Hereby, the snap protrusion only provides a holding force to avoid derailment. The friction between the rail and the flexible flange is minimized during running of the toy vehicle and a high speed toy vehicle is provided.

The rail track element 20 comprises a set of parallel rails 21 supported by rail webs 22. The rail webs 22 are connected to a platform 29 comprising a first type of coupling members 30 and a second type of complementary coupling members 33. The different types of coupling members may be in the form of coupling studs and complementary coupling members, such as a coupling stud and stud-receiving recesses.

In FIG. 3 the two flexible flanges 17 are flexible in a direction away from each other in a direction transverse the longitudinal direction of the toy vehicle 1, such that the snap protrusions 18 are adapted to slide past the outer surface of the rails 21, and snap the toy vehicle 1 onto the rails 21. As the toy vehicle 1 is snapped onto the rails 21, the protrusions 18 extend underneath the rails 21 towards the rail web 22.

The wheels are shaped like a train wheel comprising an inner flange 16 adapted to engage the inner surface of the rails 21.

In the transverse direction the distance between the two wheels 15 is smaller than the distance between the two oppositely positioned flexible flanges 17. In the transverse direction the distance between the parallel rails 21 is smaller than the distance between the flexible flanges 17. Thereby, the wheels 15, the flexible flanges 17 and snap protrusions 18 are adapted to partly encircle the rails.

Derailment is avoided as the wheels 15 together with the flexible flange 17 comprising the snap protrusion 18 partly encircle the rails.

The coupling organs 13,14 are illustrated as protrusions having different shapes in order to recognize the different functions. For example, the coupling member 13 illustrates a front which may engage corresponding coupling organs of another toy vehicle.

Figure 4:
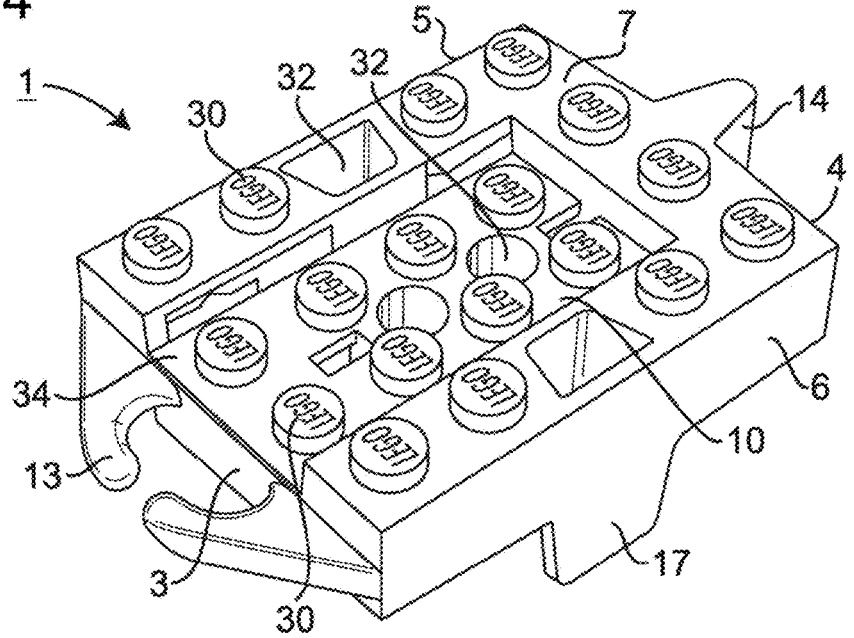
FIG. 4 is a perspective view of a toy vehicle.

FIG. 4 illustrates a perspective view of a toy vehicle. The toy vehicle comprises a chassis 10 comprising two oppositely positioned side faces 5,6. The side face 6 comprises a flexible flange 17. The chassis 10 comprises two oppositely positioned ends, the first and second ends 3,4, respectively.

The chassis 10 comprises a top portion 7 comprising a first type of coupling members 30. The toy vehicle 1 comprises a lowered top part 34 adapted to accommodate e.g. one or more toy construction elements 40, e.g. a mini figure. Hereby the center of gravity is lowered and the tendency to tilt the toy vehicle on the rails 21 is minimized, and friction between the flexible flange 17 and a rail 21 is minimized, and thus higher speed is obtained, and increased variability of play.

The toy vehicle 1 comprises through holes 32 in the top portion 7 and in the top part 34.

Figure 5:
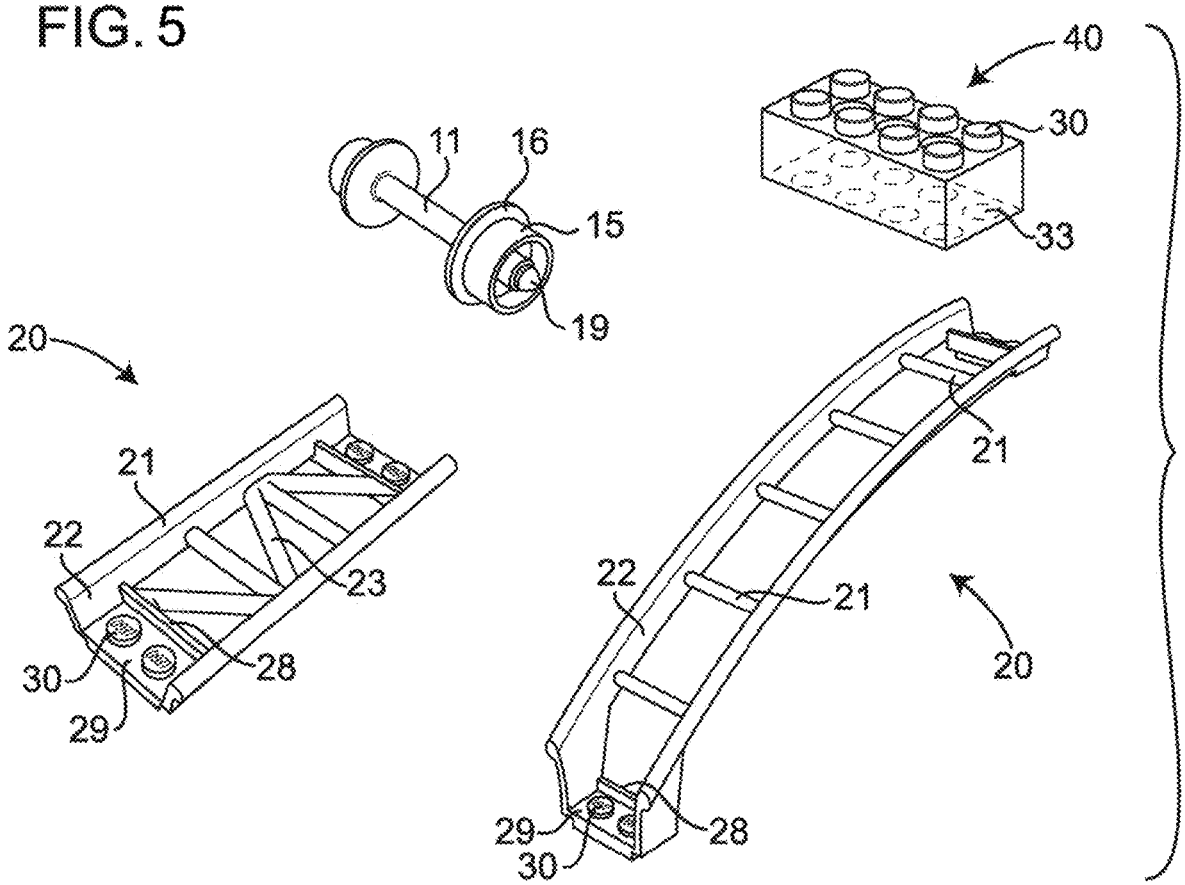
FIG. 5 is a perspective view of an axle comprising wheels, two rail track construction members and a toy construction element.

FIG. 5 illustrates in a perspective view an axle 11 shaft comprising a pair of wheels 15, two rail track construction elements 20 and a toy construction element 40.

The wheels 15 are affixed to the axel 11, such that the axel 11 and wheels 15 rotate as one cohesive unit. The wheels comprise a flange 16, such that the wheels 15 are shaped as train wheels.

Preferably, the axle 11 and wheels 15 may be manufactured as one cohesive unit by injection molding or 3D printing. Hereby reduced production costs are achieved.

The rail track construction element 20 illustrated in FIG. 5 comprises a parallel set of rails 21 supported by a set of rail web 22. The distance between the parallel rails 21 is smaller than the distance between the two oppositely positioned flexible flanges 17 in a direction transversely to the longitudinal direction of the toy vehicle 1. Hereby, the toy vehicle 1 is adapted for snapping onto the rail track construction elements 20.

The rail web 22 is connected to two platforms 29. The two platforms are positioned in each end of the rail track construction element 20. The platforms 29 are adapted for coupling rail track construction elements 20 together by toy construction elements 40 comprising coupling members 30 and complementary coupling members 33.

The rail track construction element 20 can be coupled to another rail track construction element to form a continuously rail track.

The toy construction element 40 illustrated in FIG. 5 comprises first type of coupling members 30 and complementary shaped second type of coupling members 33. The different types of coupling members may be in the form of coupling studs and complementary coupling members, such as a coupling stud and stud-receiving recesses.

A toy construction system comprising toy construction elements 40, which comprises coupling members 30,33, allows a user to create a large set of distinct spatial structures.

The toy construction system comprises at least one toy vehicle 1 and a plurality of rail track construction elements 20 and a plurality of toy construction elements 40.

Generally, the toy vehicle 1, the rail track construction element 20 and the toy construction elements 40 are provided with a first type of coupling member 30 and a second type of coupling members 33, such as coupling studs and stud-receiving recesses or other pairs of complementary coupling members configured to engage each other so as to form a physical connection.

Generally, in some embodiments, a toy construction element 40 may define a plurality of faces, e.g. a top face, a bottom face and a number of side faces. In some embodiments a given face may include one or more coupling members 30,33.

When the coupling members are removably interconnectable, the user may deconstruct previously built spatial structures and re-use the toy construction elements to build new spatial structures. For example, the toy construction elements may be interconnected/coupled to each other by traction/friction or by an interlocking connection.

A spatial structure comprises a plurality of toy construction elements directly or indirectly connected with each other by means of the coupling members. The toy construction elements are interconnectable so as to form a coherent spatial structure.

The toy construction system is a three dimensional system, wherein the user is able to create spatial structures in three dimensions.

The invention claimed is:

1. A toy vehicle configured for running on rails, the toy vehicle comprises a chassis comprising a first end and a second end, two side faces extending in a longitudinal direction of said toy vehicle and a top part, said toy vehicle comprising at least two axels, said at least two axels each comprising two wheels, wherein the chassis comprises at least two flexible flanges, said two flexible flanges being positioned opposite each other on both sides of said chassis on each side faces, each flexible flange-comprising a snap protrusion at an extremity of the flanges, said snap protrusions extending at a distance below the wheels and towards each other in a direction parallel to an extension of said at least two axels, said at least two flexible flanges being flexible in a direction away from each other in a direction transverse the longitudinal direction of the toy vehicle, such that said snap protrusions are adapted to slide past an outer surface of a set of rails.

2. A toy vehicle according to claim 1, wherein said at least two flexible flanges are positioned in the longitudinal direction centrally between said at least two axels.

3. A toy vehicle according to claim 1, wherein each of the two side faces comprises an outer planar surface extending in the longitudinal direction of the toy vehicle, said outer planar surfaces of said two side faces being parallel.

4. A toy vehicle according to claim 3, wherein the at least two flanges and the side faces of the chassis extend in a common plane.

5. A toy vehicle according to claim 1, wherein the wheels are affixed to the at least two axels, such that said at least two axels and said wheels rotate as one cohesive unit.

6. A toy vehicle according to claim 1, wherein the axels and the wheels form one cohesive unit manufactured by injection molding or 3D printing.

7. A toy vehicle according to claim 1, wherein the wheels comprise a cone-shaped protrusion extending coaxially with the axles.

8. A toy vehicle according to claim 7, wherein said chassis comprises pairs of oblong recesses, the oblong recesses being positioned opposite each other on an inner surface of the side faces, the oblong recesses being adapted to obtain the cone-shaped protrusion of the wheels.

9. A toy vehicle according to claim 1, wherein said first end and said second end of the chassis comprises complementary coupling organs.

10. A toy vehicle according to claim 9, wherein a first coupling organ comprises two flexible arms extending towards each other, and a second coupling organ comprises a loop, the first coupling organ and the second coupling organ extending in a direction that is transverse to one other, the first coupling organ being adapted for grapping the second coupling organ.

11. A toy vehicle according to claim 1, wherein the chassis comprises coupling members, which are adapted for detachably interconnecting the toy vehicle with one or more toy construction elements comprising couplings members.

12. A toy construction system comprising the toy vehicle according to claim 1, the toy construction system comprising rail track construction elements and toy construction elements, said rail track construction elements and toy construction elements comprising coupling members for detachably interconnecting the elements, the rail track construction elements comprising parallel extending rails, a distance between the rails being smaller than a distance between the flexible flanges in a direction that is transverse to the longitudinal direction of the toy vehicle, said toy vehicle being adapted for snapping onto said rail track construction elements.

* * * * *